US005126068A

United States Patent [19]

Burke et al.

[11] Patent Number: 5,126,068

[45] Date of Patent: Jun. 30, 1992

[54] HARD SURFACE CLEANING COMPOSITION CONTAINING POLYACRYLATE COPOLYMERS AS PERFORMANCE BOOSTERS

[76] Inventors: John J. Burke, 31448 Orchard Creek Rd., Farmington Hills, Mich. 48018; Robert R. Roelofs, 2099 McLain, Lincoln Park, Mich. 48146

[21] Appl. No.: 654,864

[22] Filed: Feb. 13, 1991

Related U.S. Application Data

[63] Continuation of Ser. No. 348,268, May 5, 1989, abandoned.

[51] Int. Cl.[5] ..... C11D 1/722; C11D 3/37; C11D 3/43

[52] U.S. Cl. ..... 252/174.21; 252/174.24; 252/158; 252/156; 252/173; 252/DIG. 14; 252/DIG. 10

[58] Field of Search ..... 252/158, 156, 174.21, 252/174.22, 174.24, 173, DIG. 14, DIG. 10

[56] References Cited

U.S. PATENT DOCUMENTS

| | | | |
|---|---|---|---|
| 2,674,619 | 4/1954 | Lundsted | 252/174.21 |
| 2,677,700 | 5/1954 | Jackson et al. | 252/174.21 |
| 2,979,528 | 4/1961 | Lundsted | 252/117 |
| 3,342,740 | 9/1967 | Kazmierczak et al. | 252/153 |
| 3,679,609 | 7/1972 | Castner | 252/527 |
| 3,696,043 | 10/1972 | Labarge et al. | 252/153 |
| 3,839,234 | 10/1974 | Roscoe | 252/544 |
| 3,882,038 | 5/1975 | Clayton et al. | 252/164 |
| 3,922,230 | 11/1975 | Lamberti et al. | 252/89 |
| 3,939,090 | 2/1976 | Zmoda | 252/90 |
| 4,243,559 | 1/1981 | Imamura et al. | 252/548 |
| 4,508,635 | 4/1985 | Clarke | 252/174.23 |
| 4,576,738 | 3/1986 | Colodney et al. | 252/559 |
| 4,597,887 | 7/1986 | Colodney et al. | 252/106 |
| 4,606,842 | 8/1986 | Keyes et al. | 252/174.23 |
| 4,673,523 | 6/1987 | Smith et al. | 252/91 |
| 4,690,779 | 9/1987 | Baker et al. | 252/546 |
| 4,725,655 | 2/1988 | Denzinger et al. | 252/175 |
| 4,759,868 | 7/1988 | Clarke | 252/170 |
| 4,784,789 | 11/1988 | Jeschke et al. | 252/174.23 |
| 4,917,813 | 4/1990 | Aoyagi et al. | 252/99 |

FOREIGN PATENT DOCUMENTS 5966497 10/1982 Japan .

OTHER PUBLICATIONS

English Translation of JP-59-66497.

*Primary Examiner*—Paul Lieberman
*Assistant Examiner*—Erin Higgins

[57] ABSTRACT

A clear, aqueous hard surface, essentially streak free, cleaning composition, comprising (a) a surfactant selected from the group of (i) polyoxyethylene/polyoxypropylene block copolymers having a number average molecular weight of from about 3000 to 7000, a percent hydrophile content of about 10 to 60 percent (ii) an alcohol ethoxylate of the formula

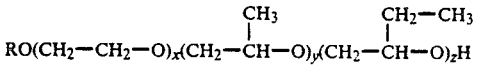

wherein R is an alkyl chain whose length is from about 8 to 15 carbon atoms, x is a number from about 4 to 15, y is a number from about 0 to 15, and z is a number from about 0 to 5, and mixtures thereof; and (b) 3 to 5 percent by weight organic solvents and water. The composition may also include a synergistic amount of a polycarboxylate copolymer comprised of a combination of copolymerized monomer units, monoethylenically unsaturated mono- and dicarboxylic acids, diolefins and alkyl vinyl ethers.

The general structure of said copolymer is as follows:

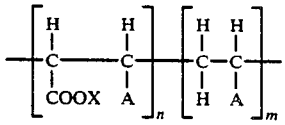

wherein X=H, Na, or similar alkaline metals; A=H, COOH, COONa or similar salts, or an alkyl group having a chain length of 6 to 20 carbon atoms and preferably 6 to 10 carbon atoms, and m and n are numbers such that the monomer ratio is in the range of about 3:1 to 1:3 and a total average molecular weight of the copolymer is from 1,000 to 70,000.

4 Claims, No Drawings

HARD SURFACE CLEANING COMPOSITION CONTAINING POLYACRYLATE COPOLYMERS AS PERFORMANCE BOOSTERS

This is a continuation of co-pending application Ser. No. 07/348,268 filed on May 5, 1989, now abandoned.

BACKGROUND OF THE INVENTION

1. Field of the Invention

The present invention relates to glass or glossy surface cleaning compositions containing certain polyoxypropylene/polyoxyethylene copolymer surfactants, organic solvents, pH adjustors and water which provides improved cleaning without the normally high levels of organic solvents or other performance additives usually used in such cleaning compositions The present invention further relates to glass or glossy hard surface cleaning compositions, especially glass cleaning compositions consisting of organic solvents, polycarboxylates, pH adjustors and certain polyoxypropylene/polyoxyethylene copolymer surfactants which, together, produce a synergistic effect and exhibit cleaning capabilities which are unexpected and represent an advance in the art.

2. Description of the Related Art

Keyes et al, U.S. Pat. No. 4,606,842 disclose cleaning compositions for glass and similar glossy hard surfaces. The compositions contain polyacrylic resins which may be comprised of a polyacrylic acid or a mixture of polyacrylic acid and an acrylic polymer complex with a phosphinate or sulfur containing moiety which is used as a builder in an aqueous glass cleaning composition of the spray on, wipe-off type containing an organic solvent system and at least one detergent surface active agent. The polyacrylic resin is of a low molecular weight and is used as a substitute builder. There is no showing of performance enhancement with the specific nonionic polyoxyalkylene block copolymers useful in the present invention.

Baker et al, U.S. Pat. No. 4,690,779 disclose hard surface cleaning compositions which are claimed to be non-streaking. There are disclosed therein chain polymers of polyacrylic acid in combination with certain nonionic surfactants which function together as hard surface cleaners. The polymers of the polyacrylic acid must have a molecular weight of below 5,000. In the present invention, the molecular weight of the polyacrylic copolymers is above 5,000 and the surfactants which are disclosed in Baker et al are not the same surfactants as those useful in the present invention.

Lamberti et al, U.S. Pat. No. 3,922,230 disclose oligomeric polyacrylates as builders in detergent compositions. There is no showing in Lamberti et al of the synergistic effect between the polyacrylates and certain nonionic surfactants to render improved hard surface cleaning compositions which are essentially streak free.

Denzinger et al, U.S. Pat. No. 4,725,655 disclose a preparation of copolymers of monoethylenically unsaturated mono- and dicarboxylic acids and anhydrides. Although these copolymers are useful in the composition of the present invention, there is no showing in Denzinger et al of the synergistic effect between certain copolymers prepared in this manner and certain nonionic block copolymers which together produce a hard surface cleaning composition which is substantially streak free and superior in performance to compositions of the prior art.

Smith et al, U.S. Pat. No. 4,673,523, disclose a cleaning solution comprising a water/alcohol mixture; an anionic surfactant; a glycol ether; an anionic polysulfonic acid; and an anhydride compound comprising an olefin/maleic anhydride copolymer, a monomeric cyclic anhydride or mixtures thereof. The olefin/maleic anhydride copolymer is a copolymer derived from substituted or unsubstituted maleic anhydride and a lower olefin in place of all or a portion of the cyclic anhydride. The maleic anhydride monomer is of the formula:

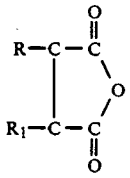

wherein R and $R_1$ are independently H, ($C_1$–$C_4$) alkyl phenyl, or phenyl ($C_1$–$C_4$) alkylene; and most preferably, R and $R_1$ are H. The lower olefin component is preferably a ($C_2$–$C_4$) olefin such as ethylene, propylene, butylene, isobutylene or isopropylene, and preferably is ethylene.

SUMMARY OF THE INVENTION

The present invention relates to the use of certain ethylene oxide/propylene oxide copolymer surfactants, and organic solvents in combination with certain polycarboxylate copolymers as effective cleaning ingredients in hard surface cleaners and particularly in glass cleaners. The present invention is substantially streak free when applied to glossy or transparent surfaces. Certain soils such as oily soils are particularly difficult to remove in a residue free fashion from such surfaces but they are easily removed using the formulation of the present invention.

The compositions of typical commercial ready to use glass cleaners include relatively large quantities (up to 11 percent) organic polar solvents and/or lower aliphatic monohydric alcohols (0.5 to 8 percent). Desirable cleaning action also requires at least one compatible nonionic or anionic surface active agent, the amount being limited because these typically cause residue to be left on glossy surfaces in the form of streaks or spots. Suitable adjuvants may include, among others, builders such as acrylic acid homopolymers and their salts, alkali metal phosphates, or a complex having the best properties of both. Other typical builders include fugitive/non fugitive alkaline compounds, corrosion inhibitors, antifogging agents and foaming agents. In compositions such as those of the present invention, water is a typical dilutent.

It has been particularly found in the present invention that certain block copolymer surfactants of ethylene oxide and propylene oxide and some alcohol ethoxylates may be used to clean glossy or transparent surfaces. Streaking or filming are virtually eliminated without the use of high amounts of solvents, alcohols, or other additives. Thus cleaning performance on oily soils on glossy surfaces is facilitated by the use of such surfactants. Moreover, use of certain of these surfactants in combination with certain polycarboxylates exhibits synergistic performance against oily soils to a level superior to that which has been observed and discovered to date. It has also been found that certain alcohol ethoxylate surfactants facilitate cleaning on glossy surfaces in a manner similar to the block copolymers previously described. To this end, the block copolymer surfactants of the present invention have a molecular weight range of from 3,000 to 7,000 and are comprised of from about 10 to 60 percent by weight oxyethylene.

Alternatively, the surfactant can be an oxyalkylate of the general structure:

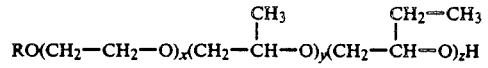

wherein R is an alkyl chain whose length is from about 8 to 15 carbon atoms, x is a number from about 4 to 15, y is a number from about 0 to 15, and z is a number from about 0 to 5.

The polycarboxylate copolymer of particular interest is comprised of maleic acid and acrylic acid. The monomer ratio of maleic acid to acrylic acid is in the range of 3:1 to 1:3 with a total average molecular weight of from 1,000 to 70,000. Preferably, the monomer ratio in the copolymer is 1:1 and the molecular weight of the copolymer is in the range of about 1,000 to 25,000.

DETAILED DESCRIPTION OF THE PREFERRED EMBODIMENT

The present invention relates to the use of certain ethylene oxide/propylene oxide block copolymer surfactants either alone or in combination with certain polycarboxylates a effective cleaning ingredients in hard surface cleaners and particularly in glass cleaners. There are many ready to use hard surface cleaners on the market which boast a wide range of performance applications from all purpose to use on specific soils and surfaces. It may be said that one of the greatest challenges facing formulators in this area is streak free cleaning of glossy or transparent surfaces. Certain soils, notably oily soils, are particularly difficult to remove in a residue free fashion from such surfaces. Accordingly, ready to use cleaning compositions aimed at such applications have been contemplated in the present invention. It has been discovered that certain block copolymer surfactants of ethylene oxide and propylene oxide as well as some alcohol oxyethylates may be used to clean glossy or transparent surfaces. Streaking and filming are virtually eliminated without the use of high amounts of solvent, alcohol or other additives which are present in compositions of the prior art. Thus, cleaning performance against oily soils on glossy surfaces is enhanced by the use of such surfactants. Moreover, using certain of these surfactants in combination with certain polycarboxylates, exhibits synergistic performance against oily soils to a level superior to that which has been seen in compositions of the prior art.

The polycarboxylate copolymers contemplated for use in the present invention contain combinations of copolymerized monomer units, monoethylenically unsaturated mono- and dicarboxylic acids, diolefins and alkyl vinyl ethers. The copolymers are comprised of from 90 to 10 percent by weight of a monoethylenically unsaturated dicarboxylic acid of 4 to 6 carbon atoms, its salt and/or if appropriate, its anhydride, and a comonomer selected from the group a) from 90 to 10 percent by weight of a monoethylenically unsaturated monocarboxylic acid of 3 to 10 carbon atoms and/or its salt, b) from 90 to 10 percent by weight of an alkene containing 6 to 10 atoms.

c) from 90 to 10 percent of a $C_1$ to $C_4$ alkyl vinyl ether, and mixtures of (a), (b) and (c).

The starting comonomers of the polycarboxylates useful in the present invention are monoethylenically unsaturated dicarboxylic acids, their salts and/or, where the steric arrangement of the carboxyl groups permits ("cis" position), their anhydrides. Examples of suitable dicarboxylic acids of 4 to 6 carbon atoms are maleic acid, itaconic acid, mesaconic acid, fumaric acid, methylene malonic acid, and their salts and, in the appropriate cases, their anhydrides.

The starting monomers (a) are monoethylenically unsaturated monocarboxylic acids and/or their salts. They may contain from about 3 to 10 carbon atoms in the molecule. Acrylic acid and methacrylic acid are particularly suitable compounds, but it is also possible to use, for example, vinyl acetic acid, allyl acetic acid, propylenedene acetic acid, ethylenedene propionic acid, dimethyl acrylic acid, $C_2$–$C_4$-alkyl half esters of the above dicarboxylic acids, in particular of maleic acid, as well as mixtures of the starting comonomer already mentioned above.

For the purposes of the present invention, salts of the carboxylic acids already mentioned are alkyl metal salts, preferably sodium salts and potassium salts, ammonium salts and organic amine salts, such as those of the tri-$C_1$–$C_4$-alkyl amines, of hydroxy ethylamine or of mono-, di- and tri-$C_1$–$C_4$ alkanolamines, and mixtures thereof.

The starting monomers of (b) are selected from the group consisting of substituted and unsubstituted alkenes having from about 4 to 10 carbon atoms. Representative examples include 2-methylpropane, 1-pentene, 1-decene, diisobutylene, 2,4,4-trimethyl-2-pentene and mixtures thereof.

The starting monomers (c) are selected from the group consisting of $C_1$ to $C_4$ vinyl ethers. Representative examples include methylvinylether, ethyl vinylether, propylvinylether, butylvinylether and mixtures thereof.

The general structure of the copolymer thus formed is as follows:

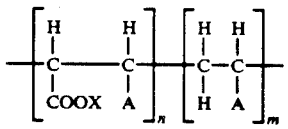

wherein X=H, Na, or similar alkaline metals; A=H, COOH, COONa or similar salts, or an alkyl group having a chain length of 6 to 20 carbon atoms and preferably 6 to 10 carbon atoms, and m and n are numbers such that the monomer ratio is in the range of about 3:1 to 1:3 and a total average molecular weight of the copolymer is from 1,000 to 70,000. The most preferred monomer ratio is in the range of 1:1. The preferred molecular weight range of the copolymer is 1,000 to 25,000 and most preferably 12,000.

The nonionic surfactants useful in the present invention are preferably polyoxyalkylene polyethers terminated with oxyethylene groups. Generally the terminal atom on the chains of such compounds is a hydrogen atom which is preceded by the polyoxyethylene group. However, for simplicity's sake, and as generally used in the art, the expression "terminated with the oxyethylene group", as used throughout the instant specification and claims, includes compounds having terminal hydrogen atoms.

A preferred type of oxyethylene group terminated polyoxyalkylene polyethers is a cogeneric mixture of conjugated polyoxyalkylene compounds containing in their structure, oxyethylene groups, oxypropylene groups and oxybutylene groups and the residue of an active hydrogen containing compound. The term "cogeneric mixture" used herein is a term that has been coined to designate a series of closely related homologues that are obtained by condensing a plurality of alkylene oxide units with a reactive hydrogen compound. This expression is well known to those skilled in the art as can be seen from U.S. Pats. 2,677,700; 2,647,619; and 2,979,528.

The active hydrogen containing compound also referred to herein as an initiator has about 1 to 30 carbon atoms, preferably about 1 to 14 carbon atoms, and at least 1, preferably about 1 to 8, active hydrogen atoms. Typical initiators useful in the present invention include monofunctional or polyfunctional alcohols such as methanol, ethanol or higher branched or unbranched monofunctional alcohols, hexyl alcohol, octyl alcohol, decyl alcohol, stearyl alcohol, and mixtures thereof, phenol, alkyl phenols and dialkyl phenols, difunctional alcohols such as ethylene glycol, propylene glycol, butylene glycol, ethylenediamine, triethylenediamine, hexylmethylenediamine, trimethylol propane, pentaerythritol, sucrose and erythritol, $C_1$–$C_{30}$ mono- or polyalkyl phenols, polyhydroxy alkylated phenols, hydrogenated (polyphenol) alkanes, polyphenols where the aromatic rings are fused or bridged by alkyl groups or are linked directly but not fused, such as diphenols, oxyalkylated alkyl amines, aniline or other aromatic amines or polyamines, fatty acids, fatty amides, oxyalkylated fatty acids, oxyalkylated fatty amides and mixtures thereof.

A still further class of such reactive hydrogen compounds is the di- and polycarboxylic acids, such as adipic acid, succinic acid, glutaric acid, aconitic acid, diglycollic acid, and the like. It will be recognized that the reactive hydrogen compound can be one containing different functional groups having reactive hydrogen atoms, also, such as citric acid, glycollic acid, ethanolamine, and the like.

Broadly defined, the initiator may be a 1,2- or 1,X-difunctional alcohol where X is an integer not exceeding the number of carbon atoms in the alcohol, monoalkyl ethers of the above-mentioned glycols, or other higher functional alcohols.

Other typical initiators may include amines, amides, mercaptans and carboxylic acids. Indeed, other surfactants may be useful as starting materials for the surfactants used in the instant invention. These include oxyalkylated amines, oxyalkylated fatty acids and oxyalkylated fatty amides.

These initiator compounds may be heteric or block, as long as they may be terminated with oxyethylene groups and are characterized in that the oxyalkylene groups are attached to the initiator compound at the site of the reactive hydrogen atoms.

In one preferred embodiment of this invention, the oxyalkylene compounds are those of the type more completely disclosed in U.S. Pat. No. 2,674,619 prepared by first oxypropylating an initiator and subsequently oxyethylating the resulting compound, incorporated herein by reference. In such compounds, the polyoxypropylene groups are attached to the initiator nucleus at the site of the reactive hydrogen atoms, thereby constituting a polyoxypropylene polymer. The oxyethylene chains ar attached to the polyoxypropylene polymer in oxyethylene chains. The oxypropylene chains optionally, but advantageously, contain small amounts of ethylene oxide and the oxyethylene chains optionally but advantageously contain small amounts of other alkylene oxides such as propylene oxide and/or butylene oxide. Such compounds are believed to correspond to the formula:

$$Y[C_3H_6O)_n(C_2H_4O)_mH]_x \qquad \text{I}$$

Wherein Y is the residue of an organic compound having from about 1 to 30, preferably about 1 to 14 carbon atoms and containing x reactive hydrogen atoms in which x has a value of at least 1, preferably about 1 to 8, n has a value such that the molecular weight of the polyoxypropylene hydrophobic base is about 300 to 6,000 and m has a value such that the oxyethylene content of the molecule is from about 10 to 60, preferably 10 to 40 weight percent of the molecule.

It is further noted that when the molecular weight is stated in this specification or in the claims, unless otherwise noted, there is meant the average theoretical molecular weight which equals the total of the grams of the alkylene oxide employed per mole of reactive hydrogen compound. It is well recognized in the field of alkylene oxide chemistry that the polyoxyalkylene compositions one obtains by condensing an alkylene oxide with a reactive hydrogen compound are actually polymeric mixtures of compounds rather than a single molecular compound. The mixture contains closely related homologues wherein the statistical average number of oxyalkylene group equals the number of moles of the alkylene oxide employed and the individual members in the mixtures contain varying numbers of oxyalkylene groups. Accordingly, as already noted, the oxypropylene chains optionally but advantageously may contain small amount of ethylene oxide and the oxyethylene chains optionally but advantageously contain small amounts of alkylene oxides such as propylene oxide and butylene oxide. Thus, the compositions of this invention are mixtures of compounds which are defined by molecular weight of the polyoxypropylene chains and weight percent of oxyethylene groups.

Preferred compounds of the Formula I are those where Y is a residue of propylene glycol, or propylene glycol mono methylether whereby the formulae then become $$CH_3O(C_3H_6O)_n(C_2H_4O)_mH \qquad \text{II}$$

or $$HO(C_2H_4O)_m(C_3H_6O)_n(C_2H_4O)_mH \qquad \text{IIa}$$

wherein n has a value such that the molecular weight and the polyoxypropylene hydrophobic base is about 300 to 6,000, and m has a value such that the oxyethylene content of the molecule is from about 10 to 60, preferably 10 to 40 weight percent of the molecule. Heteric structures are also included and the resulting formula is modified as is well known to one skilled in the art.

Nitrogen-containing polyoxyalkylene compositions are included in the present invention which are similar to those described in U.S. Pat. No. 2,979,528. These compounds are prepared in much the same manner as those disclosed in accordance with the procedure disclosed in U.S. Pat. No. 2,679,619. However, instead of propylene glycol or propylene glycol monomethyl ether as an initiator, a reactive hydrogen compound containing nitrogen is utilized. Initiators for these compounds include ammonia, primary amines, alkylene polyamines, alkanolamines and heterocyclic nitrogen compounds. Aliphatic primary diamines, having not over 8 carbon atoms are the preferred nitrogen-containing reactive hydrogen compounds and include ethylenediamine, diethylene triamine, triethylene tetramine, tetraethylene pentamine, hexamethylene diamine, phenylene diamine and the like.

Useful nitrogen-containing nonionic surfactants are mixtures of cogeneric polyoxypropylene polyoxyethylene compounds based on a nitrogen-containing reactive hydrogen compound wherein chains of oxypropylene groups having a defined molecular weight are attached to the nucleus of the reactive hydrogen compound at the sites of the hydrogen atoms and wherein the chains of oxyethylene groups are attached to opposite ends of the oxypropylene chains. The compositions are prepared by condensing propylene oxide with a nitrogen-containing reactive hydrogen compound, preferably ethylenediamine and subsequently condensing ethylene oxide with the propylene oxide-reactive hydrogen compound. The collective molecular weight of the oxypropylene chains attached to the nitrogen-containing reactive hydrogen compound must be at least about 300 and can range up to about 6,000 or higher. Where ethylenediamine is the reactive hydrogen compound, these compounds are believed to have the following formula:

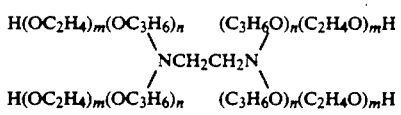

wherein n has a value such that the overall molecular weight of the polyoxypropylene hydrophobic base is about 300 to 23,750, preferably about 300 to 6,000, and m has a value such that the polyoxyethylene hydrophilic base is from about 10 to 60, preferably about 10 to 40 weight percent of the molecule. Heteric structures are also included and the resulting structure is modified as is well known to one skilled in the art.

Other polyether surfactants contemplated for use in the present invention are those wherein Y in Formula I above is methanol.

The instant invention is also applicable to conventional oxypropylene group terminated polyoxyalkylene polyols. More specifically, polymers prepared by reacting all the hydroxyl groups of the oxyethylene group terminated polyols with propylene oxide. For example, the polyols to be terminated with the oxypropylene groups could be polyoxyethylene polyether polyols similar to those described above, but having oxypropylene terminal groups such as those disclosed, including preparation thereof, in U.S. Pat. No. 3,036,118; which is oxypropylene group terminated.

As before, those skilled in the art realize that these aforementioned polyalkylene polyols can be made up of conjugated oxyalkylene polymer units or of heteric units. Similar "reverse" block and heteric structures using the aforementioned nitrogen-containing reactive hydrogen initiators are also considered of use here.

Alternatively, the surfactant can be an oxyalkylate of the general structure:

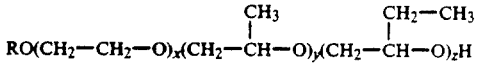

wherein R is an alkyl chain whose length is from about 8 to 15 carbon atoms, x is a number from about 4 to 15, y is a number from about 0 to 15, and z is a number from about 0 to 5.

The preferred range of the molecular weight of the block copolymer surfactant for use in the present invention is from about 3,000 to 7,000 and should contain 10 to 60 percent by weight oxyethylene.

When used in conjunction with the polycarboxylates described herein, a synergistic effect is observed between the polycarboxylate copolymer and the surfactant which results in a glass cleaning composition which has clearly superior cleaning properties than compositions previously known from the prior art which also contain adjuvants, i.e. builders.

The pH of the present invention is preferably within the alkaline range of pH. Accordingly, it is necessary to employ at least one pH adjustor in the formulation. Those skilled in the art recognize that many pH adjustors are available and one may employ any one or a combination of such adjustors to suit the formulator's needs. Typical pH adjustors may be selected from the group consisting of the alkaline salts of the metals from Group I of II of the periodical table, such as potassium and sodium salts, alkaline hydroxides such as ammonium hydroxide, and mixtures thereof. These may be employed in any amount necessary to shift the pH of the formulation to the desired alkaline range. In the formulation of the present invention, the pH adjustors may preferably be employed in an amount of from about 0.1 to 0.5 percent by weight of the composition.

The present invention also includes the use of solvents such as those well known to one skilled in the art. The organic solvents are useful as solubilizers for oily soils on hard or glossy surfaces. It is often desirable to incorporate organic solvents into such cleaning compositions because of the manner these compositions are used.

Suitable organic solvents may be selected from the group consisting of glycol ethers such as ethylene glycol monobutyl ether, diethylene glycol monobutyl ether, tripropylene monomethyl ether, propylene glycol mono tertiary butyl ether and mixtures thereof.

Cleaning compositions of the present invention contain from about 0.05 to 0.5 percent by weight surfactant, and preferably 3 to 5 percent by weight organic solvents. They may also include 0.1 to 0.4 percent by weight polycarboxylate. Other adjuvants, as are well known to those skilled in the art, may also be added, but these are not necessary for purposes of the invention.

In the following Examples, the following test methods were used.

A Gardner straight line Abrasion Tester was modified according to ASTM D4488, section A4.2.1. Ordinary plate glass samples with dimensions 4"×10"×3/16" were used as the primary substrate. Commercially available beef fat, rendered and filtered, was melted in a petri dish. The fat was applied to the glass using the edge of a wire dipped into the molten soil. A paper clip is suitable for this. Three small lines of soil were applied, equally spaced across and perpendicular to the four inch edge of the glass. This was repeated so that all three areas of the glass surface that contact the scrubber heads were treated. The soil was allowed to harden after which the scrubber heads, covered with a pre-cut piece of Scott "C-fold" paper towel, were allowed to traverse the surface 8–10 cycles to evenly spread the fat. The soiled substrate was then allowed to age in ambient conditions overnight.

A new, pre-cut piece of paper towel is affixed to each scrubber head and 0.50–0.55 g of cleaning product is applied evenly to the towel with a dropper. The heads are immediately placed into the abrasion tester and allowed to pass over the soiled glass for three complete cycles. Each glass plate is allowed to dry completely before evaluation. Replicate runs were performed.

EVALUATION PROCEDURE

A UV edge lighting system, typically used for evaluating spotting/filming of glassware, was used for this purpose. Panelists were asked to evaluate each soiled area of each substrate according to the following descriptive scale:

| RATING | DESCRIPTION |
|---|---|
| 0 | Area is crystal clear, no streaks, soil lines, film or spots. |
| 5 | No soil removal: very heavy film, may include striking soil lines; area completely covered. |

Panelists were allowed to discriminate among samples by using whole numbers from zero to five. They were allowed to discriminate even further by using decimals or fractions between each whole number within the rating scale above.

The following formulation Examples are cited to show various aspects of the invention Those skilled in the art recognize they are not to be construed as limiting the scope and spirit of the invention.

KEY TO THE EXAMPLES

Surfactant No. 1 is a polyoxyethylene/polyoxypropylene block copolymer having a number average molecularweight of about 1600 and a percent hydrophile content of about 20%.

Surfactant No. 2 is a polyoxyethylene/polyoxypropylene block copolymer having a number average molecular weight of 2500 and a percent hydrophile content of about 20%.

Surfactant No. 3 is a polyoxyethylene/polyoxypropylene block copolymer having a number average molecular weight of about 4950 and a percent hydrophile content of about 30%.

Surfactant No. 4 is a polyoxyethylene/polyoxypropylene block copolymer having a number average molecular weight of about 5000 and a percent hydrophile content of about 20%.

Surfactant No. 5 is a polyoxyethylene/polyoxypropylene block copolymer having a number average molecular weight of about 5750 and a percent hydrophile content of about 30%.

Surfactant No. 6 is a polyoxyethylene/polyoxypropylene glock copolymer having a number average molecular weight of about 6500 and a percent hydrophile content of about 50%.

Surfactant No. 7 is a polyoxyethylene/polyoxypropylene block copolymer having a number average molecular weight of about 4150 and a percent hydrophile content of about 50%.

Surfactant No. 8 is a $C_{12-15}$ alcohol ethoxylate having about 10 moles of ethylene oxide and about 5 moles of propylene oxide.

Surfactant No. 9 is a $C_{9-11}$ alcohol ethoxylate having about 7 moles of ethylene oxide and about 1 mole of butylene oxide.

Surfactant No. 10 is a $C_{10-12}$ alcohol ethoxylate having about 13 moles of ethylene oxide and about 2 moles of propylene oxide.

Additive No. 1 is a polyacrylic acid, sodium salt having an average molecular weight of 1,200.

Additive No. 2 is a polyacrylic acid, sodium salt having an average molecular weight of 2,500.

Additive No. 3 is a polyacrylic acid, sodium salt having an average molecular weight of 8,000.

Additive No. 4 is a polyacrylic acid, sodium salt having an average molecular weight of 15,000.

Additive No. 5 is a polyacrylic acid having an average molecular weight of 100,000.

Additive No. 6 is Acrysol® LMW 45N, a polyacrylic acid, sodium salt available from the Rohm & Haas Company.

Additive No. 7 is a maleic acid anhydride-methylvinyl ether copolymer, sodium salt having an average molecular weight of 70,000.

Additive No. 8 is a modified polyacrylic acid copolymer, sodium salt having an average molecular weight of 70,000.

Additive No. 9 is a modified polyacrylic acid 1 copolymer, sodium salt having an average molecular weight of 50,000.

Additive No. 10 is a maleic acid/olefin copolymer, sodium salt having an average molecular weight of 12,000.

Additive No. 11 is a modified polyacrylic acid copolymer, sodium salt having an average molecular weight of 4,000.

Additive No. 12 is a maleic acid/olefin copolymer, sodium salt having an average molecular weight of 2,000.

Additive No. 13 is a maleic acid/acrylic acid copolymer, sodium salt, having an average molecular weight of 3,000.

Additive No. 14 is a modified polyacrylic acid copolymer, sodium salt, having an average molecular weight of 20,000.

Additive No. 15 is a maleic acid/olefin copolymer, sodium salt having an average molecular weight of 12,000 esterified with a $C_{13-15}$ ethoxylated alcohol having an average of 5 moles of ethylene oxide.

Additive No. 16 is a maleic acid/olefin copolymer, sodium salt, esterified with 5 mole percent $C_{13-15}$ ethoxylated alcohol having an average of 10 moles ethylene oxide.

FORMULATIONS

The following formulations were prepared. It should be noted that these are exemplary and do not imply a limiting of scope.

EXAMPLE 1

Example 1 is an evaluation of various hard surface cleaners using the surfactants as defined above in the generalized cleaning composition noted herein. The surfactants were each used in such a formulation and were assigned a letter to indicate the formula. Each formula was evaluated according to the evaluation procedure as outlined above. In addition, various commercially available hard surface cleaning compositions were tested as set forth in the Evaluation Procedure, and the average cleaning rating of each formula is given in Table I.

| Sample Formulation | % actives w/w |
|---|---|
| Surface Active Agent | 0.25 |
| Ethylene glycol monobutyl ether | 5.00 |
| Sodium hydroxide | 0.10 |
| Deionized water | 94.65 |

Several the surface active agents employed in the above formulation and the resulting formulas were labeled as follows:

| Surfactant No. | Formula |
|---|---|
| 1 | A |
| 2 | B |
| 3 | C |
| 4 | D |
| 5 | E |
| 6 | F |
| 7 | G |
| 8 | H |
| 9 | I |
| 10 | J |
| SODIUM LAURYL SULFATE | K |

Finished commercial products were also evaluated. They are shown below by product type:

| | |
|---|---|
| Vinegar glass cleaner (Windex ®) | L |
| Vinegar glass cleaner (Glass Works ®) | M |
| Alkaline glass cleaner (Windex ®) | N |
| Alkaline multipurpose cleaner (Glass Plus ®) | O |
| Alkaline multipurpose cleaner (Sparkle ®) | P |
| All Purpose ready-to-use cleaner (Formula 409 ®) | Q |
| All purpose ready-to-use cleaner (Fantastic ®) | R |
| All purpose dilutible cleaner (Mr. Clean ®) | S |

Windex ® is a trademark of the Drackett Co.
Glassworks ® is a trademark of Miles Laboratories
Glass Plus ® is a trademark of Dow Consumer Products, Inc.
Sparkle ® is a trademark of A. J. Funk, Inc.
Formula 409 ® is a trademark of The Clorox Co.
Fantastic ® is a trademark of Dow Consumer Products, Inc.
Mr. Clean ® is a trademark of Procter and Gamble Co.

Cleaning results for all trials performed using the cleaning procedure above were:

TABLE I

| Formula | Avg. Cleaning Rating |
|---|---|
| A | 3.13 |
| B | 2.87 |
| C | 1.84 |
| D | 2.89 |
| E | 2.96 |
| F | 3.00 |
| G | 2.42 |
| H | 1.27 |
| I | 1.28 |
| J | 2.21 |

TABLE I-continued

| Formula | Avg. Cleaning Rating |
|---|---|
| K | 2.69 |
| L | 1.36 |
| M | 1.70 |
| N | 3.93 |
| O | 3.95 |
| P | 1.87 |
| Q | 5.00 |
| R | 5.00 |
| S | 4.75 |
| Ex. 1, NO SURFACTANT (Q.S. Water) | 3.83 |

EXAMPLE 2

Other formulas were prepared to determine the minimum concentration of surface active agent:

| Trial Formulas | % Active by Weight | | | |
|---|---|---|---|---|
| | I | II | III | IV |
| Nonionic No. 3 | — | 0.1 | 0.25 | 0.5 |
| Ethylene glycol monobutyl ether | 5 | 5 | 5 | 5 |
| Sodium hydroxide | 0.1 | 0.1 | 0.1 | 0.1 |
| Deionized Water | 94.9 | 94.8 | 94.65 | 94.4 |
| Cleaning results: | 3.83 | 2.75 | 1.84 | 1.79 |

EXAMPLE 3

Still other formulas were prepared to determine cleaning performance of other solvents and a frequently used monohydric alcohol:

| | % Active by Weight | | | | |
|---|---|---|---|---|---|
| | 1 | 2 | 3 | 4 | 5 |
| Nonionic No. 3 | 0.25 | 0.25 | 0.25 | 0.25 | 0.25 |
| EG monobutyl ether | 5 | — | — | — | — |
| DEG monobutyl ether | — | 5 | — | — | — |
| TPG monomethyl ether | — | — | 5 | — | — |
| PG monotert.butyl ether | — | — | — | 5 | — |
| Isopropanol | — | — | — | — | 5 |
| Sodium hydroxide | 0.1 | 0.1 | 0.1 | 0.1 | 0.1 |
| Deionized Water | q.s. | q.s. | q.s. | q.s. | q.s. |
| Cleaning results: | 1.84 | 2.55 | 3.17 | 1.83 | 2.69 |

EXAMPLE 4

Various polycarboxylates were considered as additives to determine their effect on performance.

| Sample Formula 2 | |
|---|---|
| Nonionic No. 3 | 0.25% active w/w |
| EG monobutyl ether | 5.00 |
| Sodium hydroxide | 0.10 |
| Deionized water | 94.45 |
| Additive | 0.20 |

The various additives used in sample formula 2 are those identified in the Key to the Examples. Respective cleaning result for each formula is reported in Table II.

TABLE II

| Run No. | ADDITIVE No. | Cleaning RATING |
|---|---|---|
| 1 | No Additive (Q. S. Water) | 1.84 |
| 2 | 1 | 1.31 |
| 3 | 2 | 1.44 |
| 4 | 3 | 1.33 |

TABLE II-continued

| Run No. | ADDITIVE No. | Cleaning RATING |
|---|---|---|
| 5 | 4 | 1.37 |
| 6 | 5 | 2.64 |
| 7 | 6 | 1.59 |
| 8 | 7 | 2.08 |
| 9 | 8 | 1.92 |
| 10 | 9 | 2.29 |
| 11 | 10 | 0.81 |
| 12 | 11 | 2.75 |
| 13 | 12 | 2.33 |
| 14 | 13 | 3.06 |
| 15 | 14 | 3.04 |
| 16 | 15 | 1.79 |
| 17 | 16 | 1.83 |

EXAMPLE 5

Finally, the formula below was made:

| | |
|---|---|
| EG monobutyl ether | 5.0% active w/w |
| Sodium hydroxide | 0.1 |
| Additive No. 10 | 0.2 |
| Deionized water | 94.7 |
| Cleaning results: | 2.54 |

CONCLUSIONS TO THE EXAMPLES

1. Surfactants and organic solvents are both required as a performance package in compositions of this type. Example 2, Trial I (solvent alone) compared with Trials II–IV demonstrate this.

2. Cleaning performance is at least partially dictated by surfactant structure. Cleaning results for Example 1, Formulas A–K show the wide variance in performance as a function of structure.

3. Particular surfactant structures, combined with organic solvents, unexpectedly yield at least comparable performance to formulas made more complex through the use of additives i.e., builders, etc. Table I, Formulas C, H, I compared to Formulas L–S demonstrate this.

4. Performance synergism is surprisingly found with the combination of the proper additive structure(s) and the proper surfactant structure(s) in the presence of organic solvent. A comparison of results in Table I, Formula C (also Table II, Run 1) with Table II, Runs 2–16 adequately illustrates this. Run 10 is particularly demonstrative of the synergy.

5. Synergy is further demonstrated by the fact that increasing the amount of surfactant without polycarboxylate additives does not provide the same cleaning as the combination of polycarboxylates and surfactant. As can be determined by reference to Example 2, Trial No. III and IV, it is evident that doubling the amount of surfactant does not provide the same cleaning performance as Run No. 11 of Table II wherein additive and surfactant are present in approximately the same amount as surfactant level in Example 2, IV.

6. Example 5 shows that even adequate performance cannot be achieved by the additive alone that is used for synergistic, superior performance in the proper package.

The embodiments of the invention in which an exclusive privilege of property is claimed are defined as follows:

1. A clear, aqueous, essentially streak free hard surface cleaning composition, comprising:

(a) from about 0.05 to 0.5 percent by weight of a surfactant selected from the group consisting of:

(i) a polyoxyethylene/polyoxypropylene block copolymer having a number average molecular weight of about 4950 and a percent hydrophile content of about 30%, (ii) a $C_{12-15}$ alcohol ethoxylate having about 10 moles of ethylene oxide and about 5 moles of propylene oxide, and (iii) a $C_{9-11}$ alcohol ethoxylate having about 7 moles of ethylene oxide and about 1 mole of butylene oxide;

(b) a pH adjustor in an amount sufficient to render the pH of said composition basic;

(c) from about 3 to about 5 percent by weight of an organic solvent selected from the group consisting of ethylene glycol monobutylether, diethylene glycol monobutyl ether, and propylene glycol monotertiary butyl ether;

(d) from about 0.1 to 0.4 percent by weight of an additive selected from the group consisting of:

(i) a maleic acid anhydride-methyl-vinyl ether copolymer, sodium salt having an average molecular weight of 70,000, (ii) a modified polyacrylic acid copolymer, sodium salt having an average molecular weight of 50,000, and (iii) a maleic acid/olefin copolymer sodium salt having an average molecular weight of 12,000.

2. The hard surface cleaning composition as claimed in claim 1, wherein said component (a) is a polyoxyethylene/polyoxypropylene block copolymer having a number average molecular weight of about 4950 and a percent hydrophile content of about 30%, said component (c) is ethylene glycol monobutyl ether, and said copolymer (d) is a maleic acid/olefin copolymer sodium salt having an average molecular weight of 12,000.

3. The hard surface cleaning composition as claimed in claim 1, wherein said surfactant (a) is (ii) a $C_{12-15}$ alcohol ethoxylate having about 10 moles of ethylene oxide and about 5 moles of propylene oxide, said component (c) is ethylene glycol monobutyl ether and said copolymer (d) is a maleic acid/olefin copolymer sodium salt having an average molecular weight of 12,000.

4. The hard surface cleaning composition as claimed in claim 1, wherein said surfactant (a) is (iii) a $C_{9-11}$ alcohol ethoxylate having about 10 moles of ethylene oxide and about 5 moles of propylene oxide, said component (c) is ethylene glycol monobutyl ether and said copolymer (d) is a maleic acid/olefin copolymer sodium salt having an average molecular weight of 12,000.

* * * * *